US007175356B2

(12) United States Patent
Campanini

(10) Patent No.: US 7,175,356 B2
(45) Date of Patent: Feb. 13, 2007

(54) HEAD SUPPORT BASE FOR THERMAL PRINTER

(75) Inventor: Alberto Campanini, Fidenza (IT)

(73) Assignee: Custom Engineering SpA, Fontevivo (IT)

( * ) Notice: Subject to any disclaimer, the term of this patent is extended or adjusted under 35 U.S.C. 154(b) by 177 days.

(21) Appl. No.: 10/939,043

(22) Filed: Sep. 10, 2004

(65) Prior Publication Data

US 2005/0117953 A1 Jun. 2, 2005

(30) Foreign Application Priority Data

Sep. 16, 2003 (EP) ..... 03425599

(51) Int. Cl.
*B41J 2/315* (2006.01)
*B41J 25/308* (2006.01)
*B41J 25/316* (2006.01)

(52) U.S. Cl. ..... 400/120.16; 400/120.17; 347/197; 347/198

(58) Field of Classification Search ..... 400/120.16, 400/120.17; 347/197, 198
See application file for complete search history.

(56) References Cited

U.S. PATENT DOCUMENTS 5,594,487 A * 1/1997 Nuita et al. ..... 347/197
5,892,531 A * 4/1999 Mistyurik et al. ..... 347/222

FOREIGN PATENT DOCUMENTS

EP 0 700 789 A1 3/1996
EP 0 700 789 A1 12/1996
EP 0 765 761 A1 2/1997
EP 0 765 761 A1 4/1997

OTHER PUBLICATIONS

Patent Abstracts of Japan, filed Aug. 31, 1998.

* cited by examiner

*Primary Examiner*—Daniel J. Colilla
*Assistant Examiner*—Marissa Ferguson-Samreth
(74) *Attorney, Agent, or Firm*—J. Harold Nissen; Lackenbach Siegel, LLP

(57) ABSTRACT

A head support base for a thermal printer to provide for movement of a thermal head relative to a printer paper drive roll and control the location of the thermal head relative to the paper drive roll including first and second spaced support plates, the first spaced support plate is a lower plate and is provided with support a posterior fin, anterior fins 3, three anterior ledges, a posterior ledge, and four springs, one placed onto each ledge. The first support plate is centrally provided with an opening into which a hook is inserted for connection with its other end to an upper or second spaced support plate to carry the thermal head and place the springs in compression or expansion and to limit their movement while permitting relative mobility of the first or lower support plate relative to the spaced second or upper support plate and consequently of the thermal head connected with the second or upper support plate to permit movement of the thermal head in all directions relative to the paper drive roll.

20 Claims, 8 Drawing Sheets

HEAD SUPPORT BASE FOR THERMAL PRINTER

BACKGROUND OF THE INVENTION

1. Field of the Invention

This invention is concerned with a head support for a thermal printer.

More specifically, the invention is concerned with an important feature of a thermal printer which is the location of the thermal head on the paper drive roll.

2. Description of Related Art

It is well known that problems can arise if the thermal head and the paper are not properly aligned. In this respect, the drive roll which carries the printing head is required to be aligned with the paper. A problem existing with prior art mechanisms is the accurate alignment of the thermal head on the drive roll.

Consequently, the desired or optimum position for the thermal head is that it is to be maintained in a tangential relationship to the drive roll, otherwise a poor printing quality is produced.

Moreover, printing quality is affected in response to a normal passing for the roll rotation pins or at least in a position near the points determined relative to these ideal lines, and further, considering that each movement away from the optimum or desired disposition is also a factor which affects the printing quality.

Therefore, in order to provide for desired legibility of printed material and to produce a good and possibly excellent quality printing, it was necessary to provide mechanics or mechanical arrangements for supporting the thermal head, and to provide supporting and positioning parts for the drive roll pins so as to make and position the roll pins in an extremely precise arrangement and with tolerances extremely restricted, so as to provide a printer body with high definiteness.

Costs are also a necessary factor to be considered. Therefore, it is necessary to consider the workings, together with this required definiteness, and this results in a raising of or increase in the costs of the resultant end product.

A further problem with which the prior art is concerned is that due to construction inexactnesses in the disposition of the head and in the roll disposition of the printing roll, further inexactnesses in the head and roll dispositions are due to assembling of the parts which may not be proper so that due to accidental causes such as knocks or thermal expansion.

In the prior art, there are known apparatus that provide the support with roll hooking parts for the paper but require a machine construction having exactness, and there are known compression apparatus for compression of the head onto the roll but these apparatus do not compensate for the constructive plays.

BRIEF SUMMARY OF THE INVENTION

To these ends, the present invention includes the provision of a head support for a thermal head and comprises two spaced plates or planes, one of which plates is connected with the thermal printing apparatus, and the other spaced plate supports the thermal head for juxtaposition to a printing roller or the apparatus, a connector for connecting the two spaced plates together for movement of the thermal head relative to the printing roller, a resilient mechanism associated with the two spaced plates for permitting the other spaced plate to be movable relative to the one spaced plate in a longitudinal and a transverse direction for maintaining the printing head in proper contact with the printing paper which printing paper is positioned between the printing head and the printing roller.

The resilient mechanism includes springs supported on one plate, and connectors associated with the other plate coupled with the head support and passing through the springs for permanently positioning the springs between the two spaced plates.

The connector includes fins on the one spaced plate, the fins have an opening and hook members connected with the other spaced plate and having ends receivable within the opening in the fins for connecting the two spaced plates together.

The resilient mechanism includes three front ledges and one rear ledge on the one spaced plate, a spring for each of the ledges and associated with each of the ledges, and preferably three screws associated with the three front ledges passing through openings in the other spaced plate for connecting each individually with the three ledges and passing through the springs for connection with the front ledges, and a fourth or rear connection member associated with the rear ledge passing through the spring associated with the rear ledge for coupling posterior portions of the two spaced plates together.

Fins are also provided folded at right angles to the one spaced plate or plane.

Three cylindrical anterior ledges and a posterior cylindrical ledge is provided for maintaining the four springs inserted onto a proper one of the support ledges, which springs can be placed into compression or moved into expansion by the spaced upper and lower support plates.

The first spaced support plate is provided with a substantially rectangular opening, and a hook member having one end connected to the other spaced support plate, and the hook has another end forming a connection end for insertion into the substantially rectangular opening, the hook member maintaining some of the springs under compression and limiting relative expansive mobility of other the springs and relative displacement of the spaced support plates relative to each other and thereby limiting and controlling movement of the thermal head, and thereby permit movement of the thermal head in all directions relative to the paper drive roll.

The other spaced support plate is provided with three anterior openings for placement and alignment with the anterior three ledges, three connection members each having a shank portion provided with outer threads which pass through the anterior openings and through the three screws and are screwed into the anterior three ledges.

As a further feature, the thermal head includes three blind openings above the three anterior openings for receiving one end of the anterior screws for locking the thermal head to the other spaced support plate, and the posterior screw passes through the posterior opening in the other spaced support plate into engagement with the posterior ledge for locking the other spaced support plate with the one spaced support plate.

The posterior fins are provided with circular holes to actuate the assembling of the machine body by use of pins and connection parts and includes openings, preferably rectangular openings to contain protrusions extending from the one spaced support plate.

The front fins provided with holes for the connection with the machine body or a body of thermal printing apparatus.

A feature of the invention is that the head support for the thermal printer includes a self-aligned support for the head to position the head in its ideal position and to take care of eccentricities of the paper drive roll. This permits and provides for a simplified machine, with less construction problems and to have a less expensive body machine while always producing a good printing quality.

Another feature of the invention is that the head support is capable of compensating for imperfections of the roll or the roll support carter that are generated during the construction and/or provide for compensation during the printing so that these parts are properly aligned or if the parts are not precisely assembled or for other causes.

In the aforementioned situations, when the seats of paper drive roll pins are not perfectly or properly disposed or positioned, problems arise due to positioning of the thermal head relative to the paper drive roll. As well understood, inaccuracies also influence the printing quality.

A further fundamental feature of the apparatus according to the invention is the compensation of the construction and assembling plays which permits the hooking of the roll which may not be perfect, such as a self-aligned support of the head, which assists in salvaging the plays due to the elasticity of the connections present in its interior. This provides for a support frame and to compensate for all the connected mechanics which may be less than perfect and consequently less expensive.

Moreover, in accordance with another feature of the invention, it is possible to close the printing apparatus with simple hooks without requiring a great deal of precision.

Accordingly, a further feature of the invention is to provide for longitudinal and transverse compensation for disposition mistakes, i.e. to compensate for the incorrect dispositions by means of elastic connections, and wrong or incorrect longitudinal and transverse positions and all the intermediate positions will be compensated for, and the printing head is positioned in optimum conditions independently of the construction and realization precision of the machine body.

BRIEF DESCRIPTION OF THE DRAWINGS

The invention, together with further advantages thereof, may be best understood by reference to the following descriptions taken in connection with the accompanying drawings, in which:

FIG. 8 is another rear view similar to FIG. 5 showing the thermal head in its neutral position free of any compensation for improper disposition;

FIG. 9 is another rear view of the thermal head in a disposition different from the disposition of FIG. 8 moved or displaced from its FIG. 8 position illustrating compensation required in a first way on the left side so as to bring the right and left sides into balance and to provide for proper contact of the thermal head with the printing paper;

FIG. 10 is another rear view of the thermal head in a disposition different from the disposition of FIGS. 8 and 9 with the upper plate moved or tilted to the right and displaced from its FIG. 8 position illustrating compensation required in a second way on the right side so as to bring the right and left sides into balance, and to provide for proper compensation and proper contact of the thermal head with the paper to be printed; FIGS. 8, 9 and 10 show the three different relative positions for that the disposition of the thermal head can be adjusted;

FIG. 11 is a side sectional view, partially in section to show the thermal printer in a neutral position;

FIG. 12 is another side sectional view similar to FIG. 11, and showing the thermal head tilted and raised in one way away from the lower plate as illustrated in FIG. 11 for compensation;

FIG. 13 is another side sectional view similar to FIG. 11 showing the thermal head tilted and lowered toward the lower plate for compensation in another way as illustrated in FIG. 10;

FIG. 14A illustrates the neutral position and FIG. 14B illustrates movement to the left side of the drawing as seen in FIG. 9; FIG. 14B specifically indicates the manner in which the thermal head has to be rotated, in this view to the left as shown in the drawings to compensate for irregularities, and compensation is also provided if necessary for rotation to the right side of the drawing (not shown) to take care of necessary compensation and a view thereof would be a mirror image of the view shown in FIG. 14B showing.

DETAILED DESCRIPTION OF THE INVENTION

Figure 1:
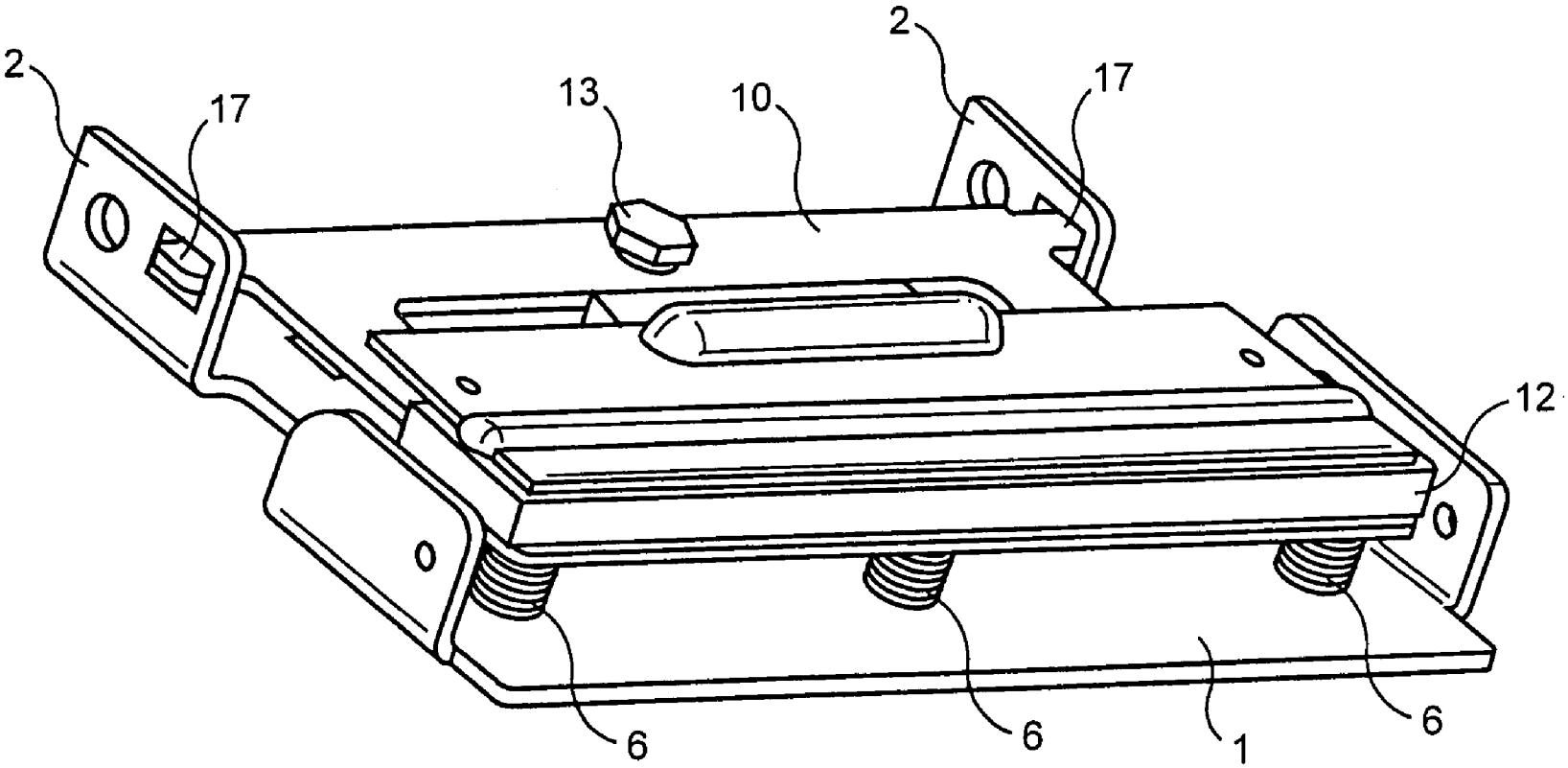
FIG. 1 is a front perspective view of a head support for a thermal printer shown in an assembled condition including lower support plane or plate 1, springs 6, upper support plate or plane 10 and thermal head 12.

Referring now more particularly to the accompanying drawings which illustrates the best mode presently contemplated for carrying out the invention concerned with a head support for a thermal printer to compensate for inaccuracies, there is provided a lower support plane or plate 1 provided with oppositely disposed posterior or rear fins 2 folded upright or upturned at right angles to the base of support plane or plate 1 and equal or equivalent anterior fins 3 also folded in an upright position at right angles to the support plane 1, to form a U-shaped arrangement. Support plane or plate 1 is provided with three cylindrical anterior ledges 4, see FIG. 2, and a posterior cylindrical ledge 5 for the purpose and function to maintain four springs 6 in a position to be inserted onto the proper and respective ledges 5, and to permit movement of upper plate 10 relative to lower plate in all directions, front and rear, and side to side.

Figure 2:
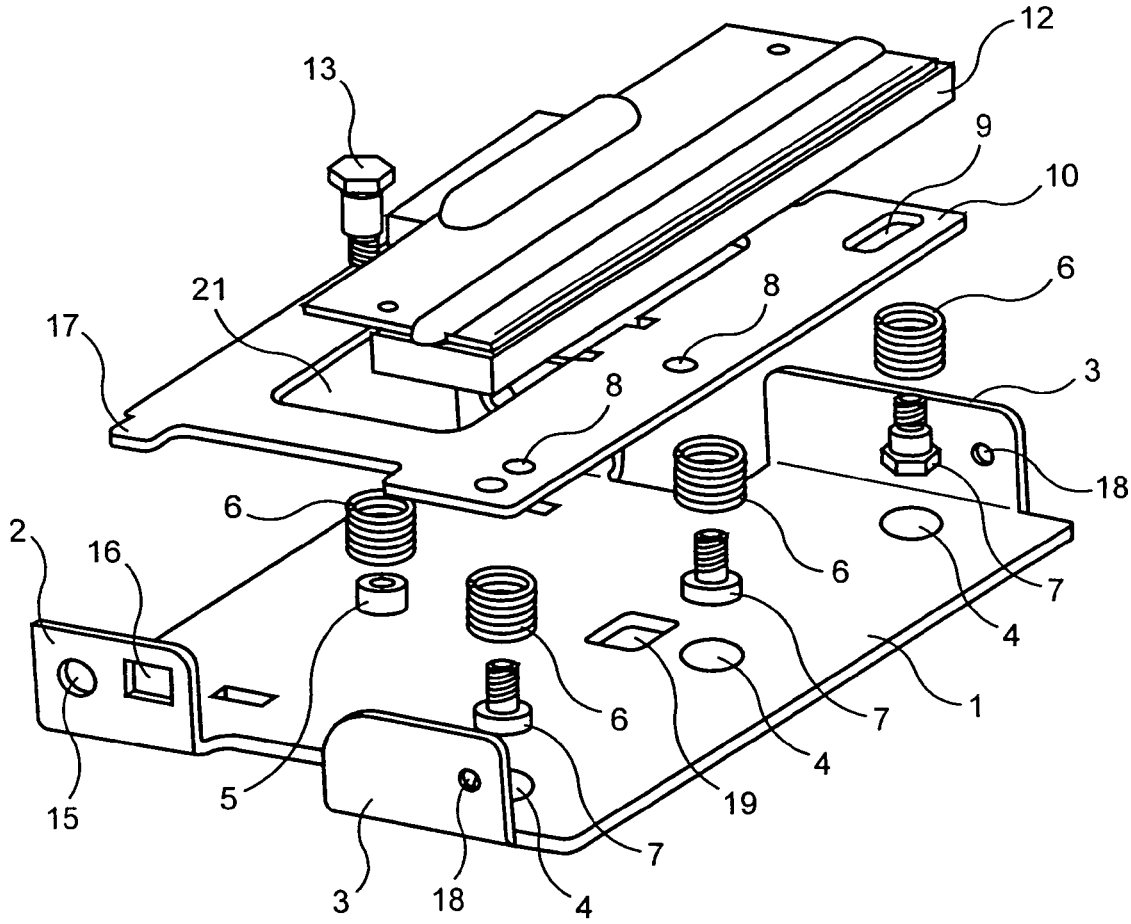
FIG. 2 is an exploded view of the thermal head support shown in FIG. 1 for a thermal printer with the lower support plate 1 and upper support plate 10 spaced and separated from each other to show the various parts.
Figure 3:
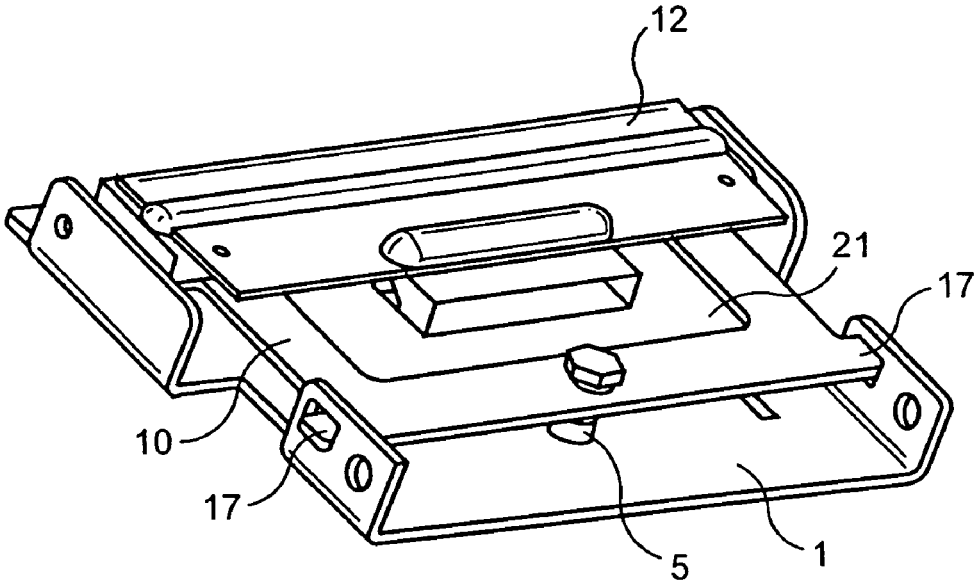
FIG. 3 is top and rear perspective view of the head support on the upper plate joined to the lower plate for the thermal printer shown in FIG. 1 illustrating the head support as viewed from the rear.

As best seen in FIGS. 1 and 2, the preferred shape of the fins 2 and 3 are substantially the same shape.

As best seen in FIG. 2, the front three cylindrical ledges or lugs 4 are proximate to the front of plate 1 and the cylindrical ledge or lug 5 positioned in back or rear of the plate 1 is closer to one of the rear fins 2, the posterior position for the purpose and function to maintain the four springs 6 in a position to be inserted.

Figure 4:
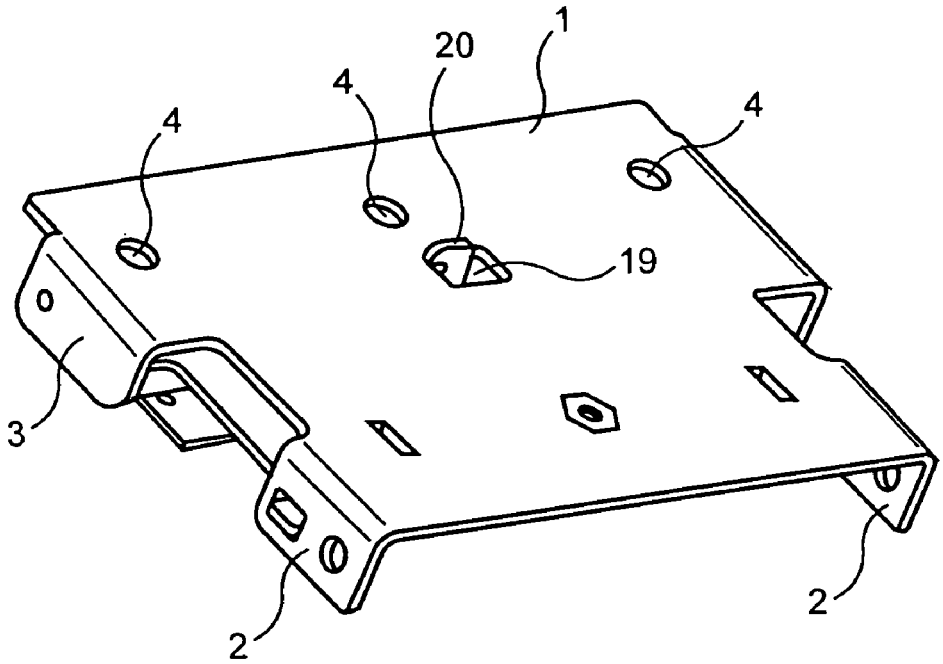
FIG. 4 is perspective view of the lower support plate looking downwardly and from the rear with the bottom of the lower plate reversed and the bottom face facing upwardly.
Figure 6:
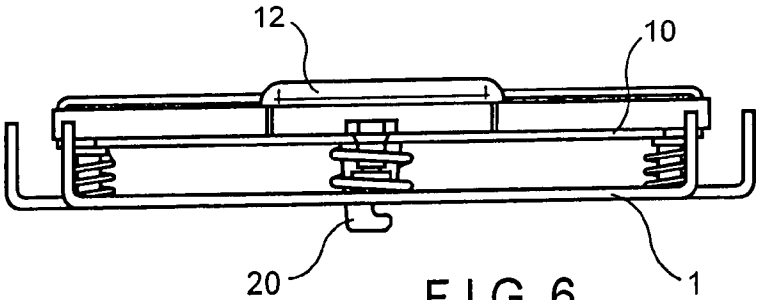
FIG. 6 is a rear view of the head support with the upper and lower plates joined and carrying the thermal head.
Figure 5:
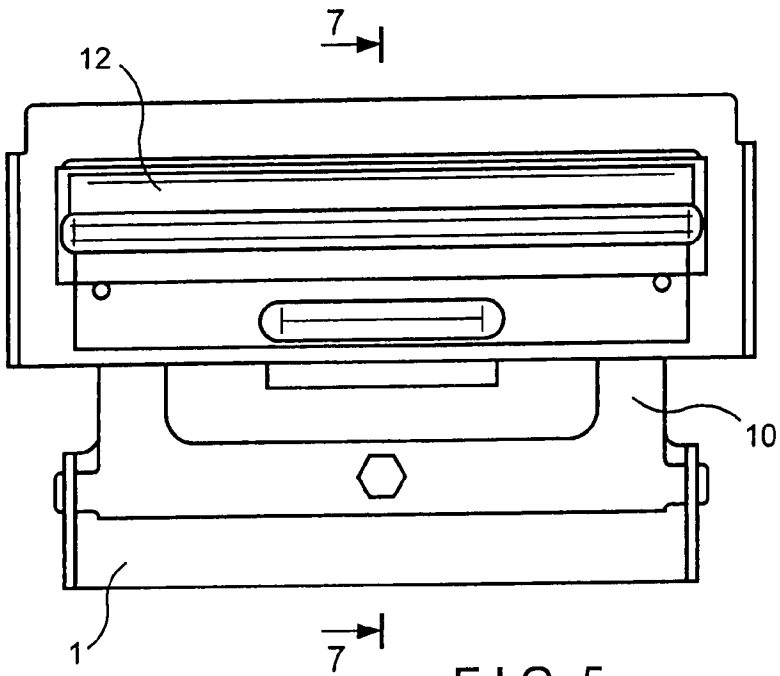
FIG. 5 is an upper view looking down on the head support with the thermal printer positioned on the upper plate and showing the lower and upper plates joined with the lower plate beneath the upper plate.

The support plane or plate 1 is centrally provided with an opening 19, preferably a squared or rectangularly shaped opening into which an end of a hook member 20, see FIGS. 4 and 6, is inserted. Hook 20 has its other end connected with the upper support plane or plate 10 for connecting lower support plane or plate 1 with upper support plane or plate 10. Springs 6 and hook member 20 are associated with and cooperate with each other so as to place springs 6 into compression, and to limit the relative mobility of spring 6, and effectively to limit the trip or movement of the spring and thereby to permit the relative mobility of the lower support plane or plate 1 and of upper support plane or plate 10. Thermal head 2 is associated with and carried by the upper support plane or plate 10.

Figure 7:
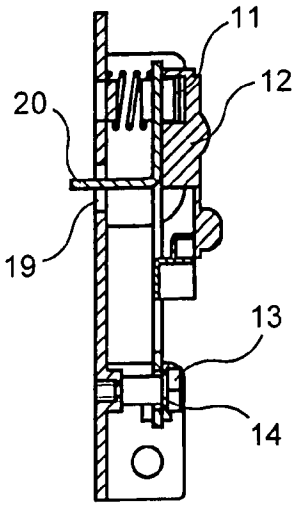
FIG. 7 is a transverse sectional view taken on line A—A of FIG. 5.

The support base for the thermal printer includes anterior springs 6 placed over the same three front screws 7, passing through openings or holes 8 provided an upper support 10 and into a hole or opening 9 of second support plane 10 and screwed into the proper threaded blind holes 11 in thermal head 12, see FIG. 7, to provide for the placement of the thermal head 2 onto the upper support plane or plate 10, and the posterior spring 6 is kept in posterior ledge or seat 5 by means of the shank position a screw 13, see FIG. 2, screwed to the hole or threaded receiving opening of the ledge 5 and passes through the hole 14, see FIG. 7, provided in upper support plane 10 which supports or carries thermal head 12.

The lower support plate 1 has on its posterior fins 2, openings, preferably circular holes 15 to actuate and to assist the assembling of the machine body by means of pins and connection parts. Lower support plate 1 also has openings, preferably rectangular opening 16, to contain or hold protrusions 17 of the upper plate support 10.

Front fins 3 are equipped with holes 18 for the connection with the machine body.

Elastic connections are obtained by means of springs 6 to permit a relative partial rotation or movement of the two spaced support plates 1 and 10 to compensate in such a way that any incorrect dispositions of the paper drive roll in comparison with the thermal head 12 is taken care of.

Any incorrect dispositions also in a transverse or a longitudinal direction is determined by the three front or anterior springs in cooperation with the rear or posterior spring.

Longitudinally and transversally compensation of the disposition mistakes or errors of the printing head is overcome so as to be position the printing head in optimum conditions independently of the construction and realization precision of the machine body.

The anterior ledges 4 and posterior ledge 5 respectively have as their function to keep or maintain in position the four springs 6 which are inserted or placed onto their respective ledges.

In FIG. 2, springs 6 are shown in spaced relationship relative to the ledges 4 and 5, and as viewed in FIG. 1, three springs are shown placed over the anterior ledges 4.

In order to provide for the appropriate vertical arrangement and relationship of the spaced support plates 1 and 10 relative to each other, screws 7 or threaded members 7 are provided which fit over ledges 4, shown spaced from ledges 4 in FIG. 2 and positioned over ledges 4 in FIG. 1 but surrounded or covered by screws 6 as also seen in FIG. 1.

Plate 10 is provided with two substantially circular openings 8 for receiving the shank portion of screws or threaded members 7 and one elongated oval or substantially rectangularly-shaped opening 9 at the right side of plate 10 as shown in FIG. 2 oblong or oval opening 19 and as best seen in FIG. 7 has two substantially parallel sides joined at their opposite ends by a semi-circular curved portion 19A.

Positioned above upper support plate 10 as best seen in FIGS. 6 and 7 is thermal head 12 provided with three blind holes 11 having an interior threaded portion for mating with threaded or anterior screw members 7 each having outer complementary threaded portions.

Upper support plate 10 is provided with a screw member 13 (FIGS. 2 and 7) which has an outer threaded shank portion and screws into rear ledge 5 having an inner cooperating and complementary threaded portion, and a rear spring 6 fits over the outer threaded shank portion of screw member 13 which passes through the inner portion of spring 6.

To maintain the vertical arrangement, and to keep the lower support plate 1 and upper support plate 10 in position and spaced from each other, anterior or front springs 6 are placed over the front or anterior three screws 7, which pass through similar holes or openings 8 and into elongated or oblong or oval-shaped hole 9 in the second support 10 and are screwed in the proper or corresponding threaded blind holes 11 (FIG. 7) provided in a joining plate portion of thermal head 12. The posterior or rear spring 6 is kept seated on rear ledge 5 by screw 13 screwed to a holding portion of ledge 5 and passes through hole 14 of the upper plate 10 holding thermal head 12.

Posterior fins 2 on support plate 1 is provided circular holes 15 to actuate and to assist the assembling of the machine body by means of pins and connection parts and to couple the thermal head support and plates 1 and 10 to the machine body or apparatus. Fins 2 are also provided with rectangular openings 16 to provide for reception and containing of protrusion 17 extending from opposite sides of upper support plate 10. The protrusions 17 are contained within and held within openings 16 to join the upper plate 10 and lower plate 1.

Front fins 3 are provided with holes 18 for connection with the machine body. As best seen in FIGS. 2 and 7, support plane or plate 1 is centrally provided with squared hole 19 into which a hook 20, see FIG. 7, is inserted for connection with the other of its ends to the upper support plate 10.

The upper support plate 10 is equipped or provided with a large dimensioned rectangular hole 21 (FIG. 2) to provide for the wiring assembling.

Hook 20 passes through opening 19 to provide for plates 1 and 10 to cooperate with each other and hook 20 places the springs 6 into compression, so as to limit the movement of the springs while permitting the relative mobility of lower support plate 1 and of upper support plate 10 relative to each other, and consequently the movement and connection of the thermal head 12 with lower support plate 1.

The elastic connections obtained as a result of the use of springs 6 permit a relative movement and rotation of the two support planes 1 and 10 relative to each other to compensate in such a way that an improper disposition of the paper drive roll in comparison with and relative to the thermal head 12.

The three front or anterior springs cooperate with the single rear or posterior spring provided for the possibility to compensate both in a longitudinal and a transverse direction so that the printing head is positioned in an optimum position for the printing operation. The springs cooperate with each other to provide for an elastic connection between lower plate 1 and upper plate 10. Of course, various intermediate positions can be obtained by virtue of the elastic connection provided by the springs.

Figure 8:
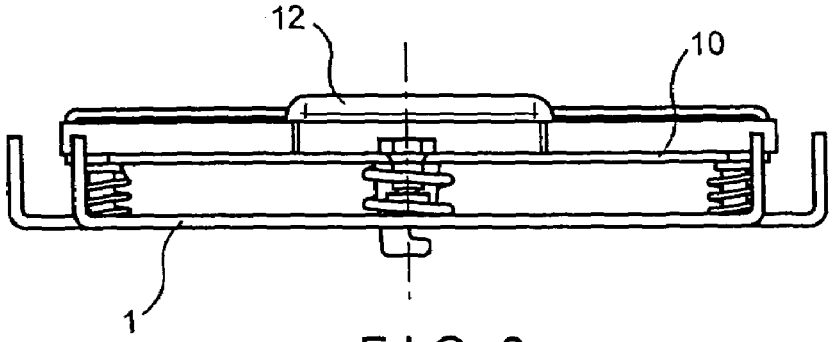
FIGS. 8, 9 and 10 are three views similar to the view shown in FIG. 5 and illustrating the upper plate in different relative dispositions to the lower plate.
Figure 9:
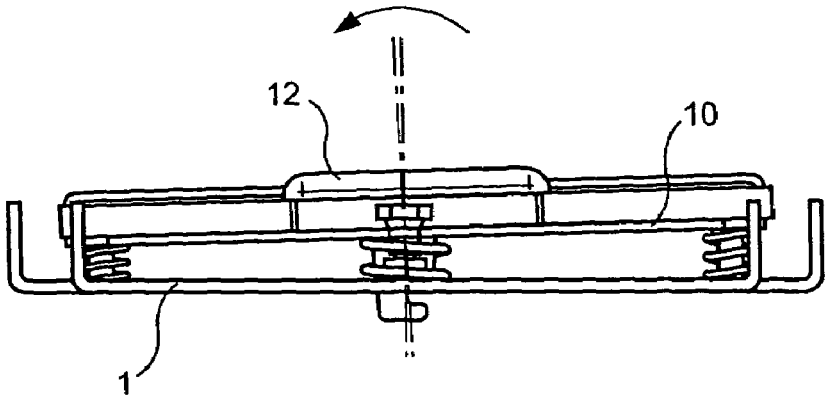
Figure 10:
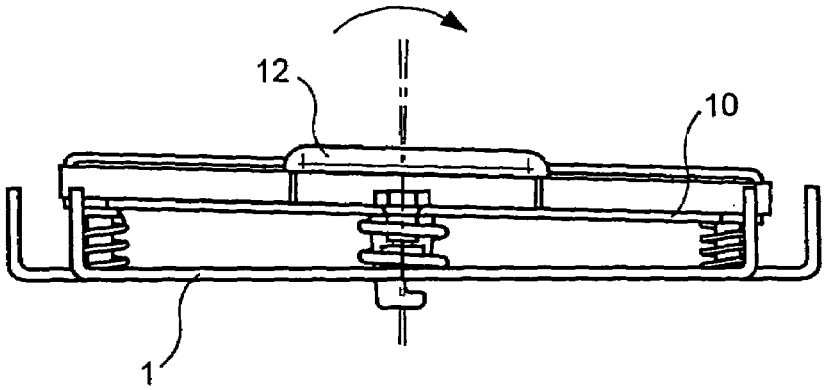

As best seen in FIGS. 8 to 10, upper plate 10 is movable in various relative positions to plate 1 so that if alignment is correct and there are no problems, the thermal head is movable so that it is in a neutral position, and then tilted towards the left when plates 1 and 10 are closer together on the left side as viewed in the drawings and tilted towards the right side when plates 1 and 10 are moved closer together on the right side as viewed in the drawings.

Figure 11:
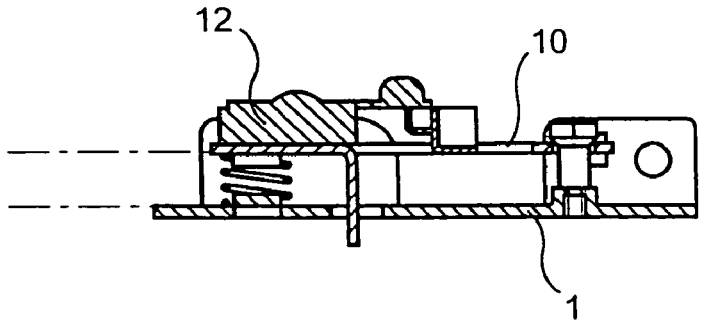
FIGS. 11, 12 and 13 are side views to show three different relative positions of the upper plate with reference to the lower plate.
Figure 12:
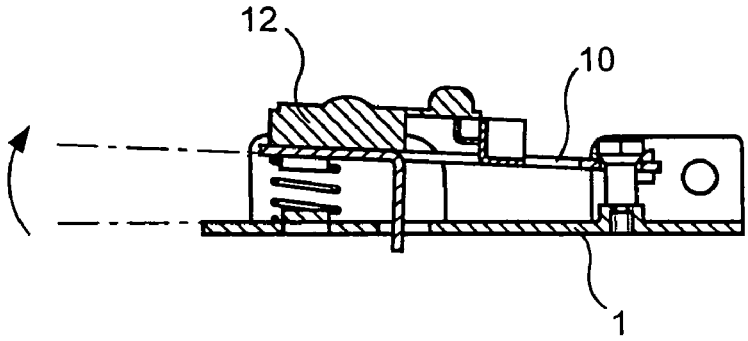
Figure 13:
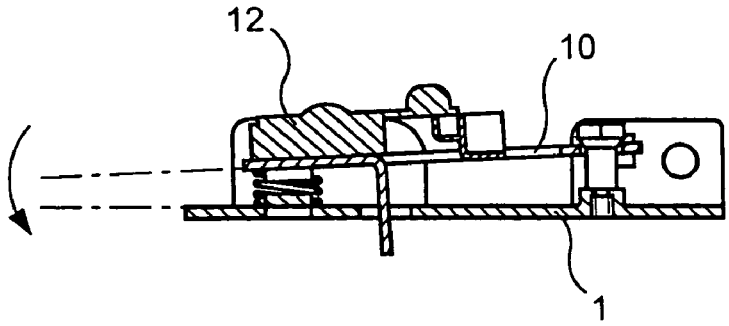

FIGS. 11 to 13 also shows the possibility of movement of the front and rear of plates 1 and 10. The neutral position is shown in FIG. 11, and tilting towards the front is shown in 12 and tilting towards the rear is shown in FIG. 13.

With these particular movements as shown in FIGS. 8 to 10 and FIGS. 11 to 13, the disposition of the thermal head can be positioned longitudinally, latitudinally and transversely.

Figure 14A:
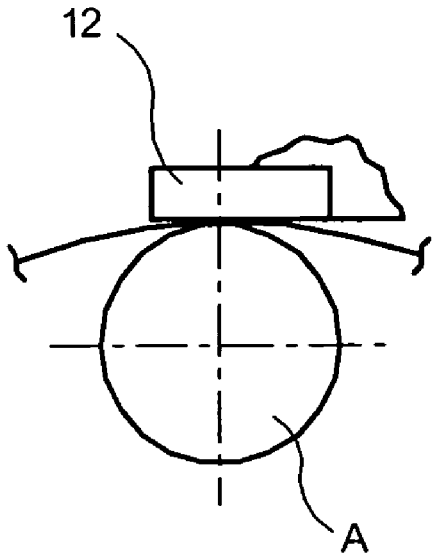
FIG. 14A illustrates the thermal head 12 and paper roll A with a paper between the thermal head and paper roll in a neutral position.
Figure 14B:
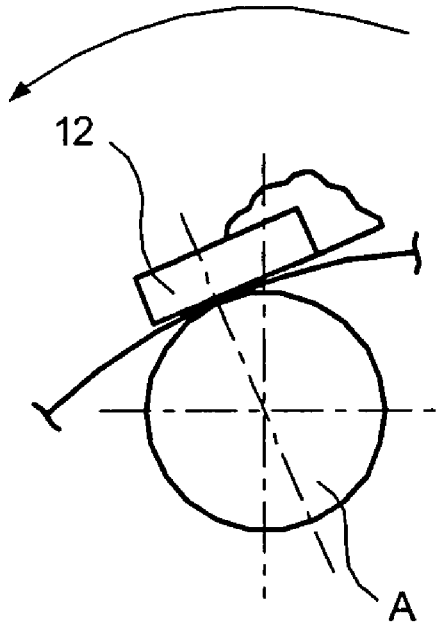
FIG. 14B is view of the rotation that is effective to compensate for the wrong or incorrect dispositions of the rubbered roll A in comparison with the thermal head 12.

FIGS. 14A and 14B exemplify the rotational movement possibility of plate 1 relative to plate 10.

Figure 15:
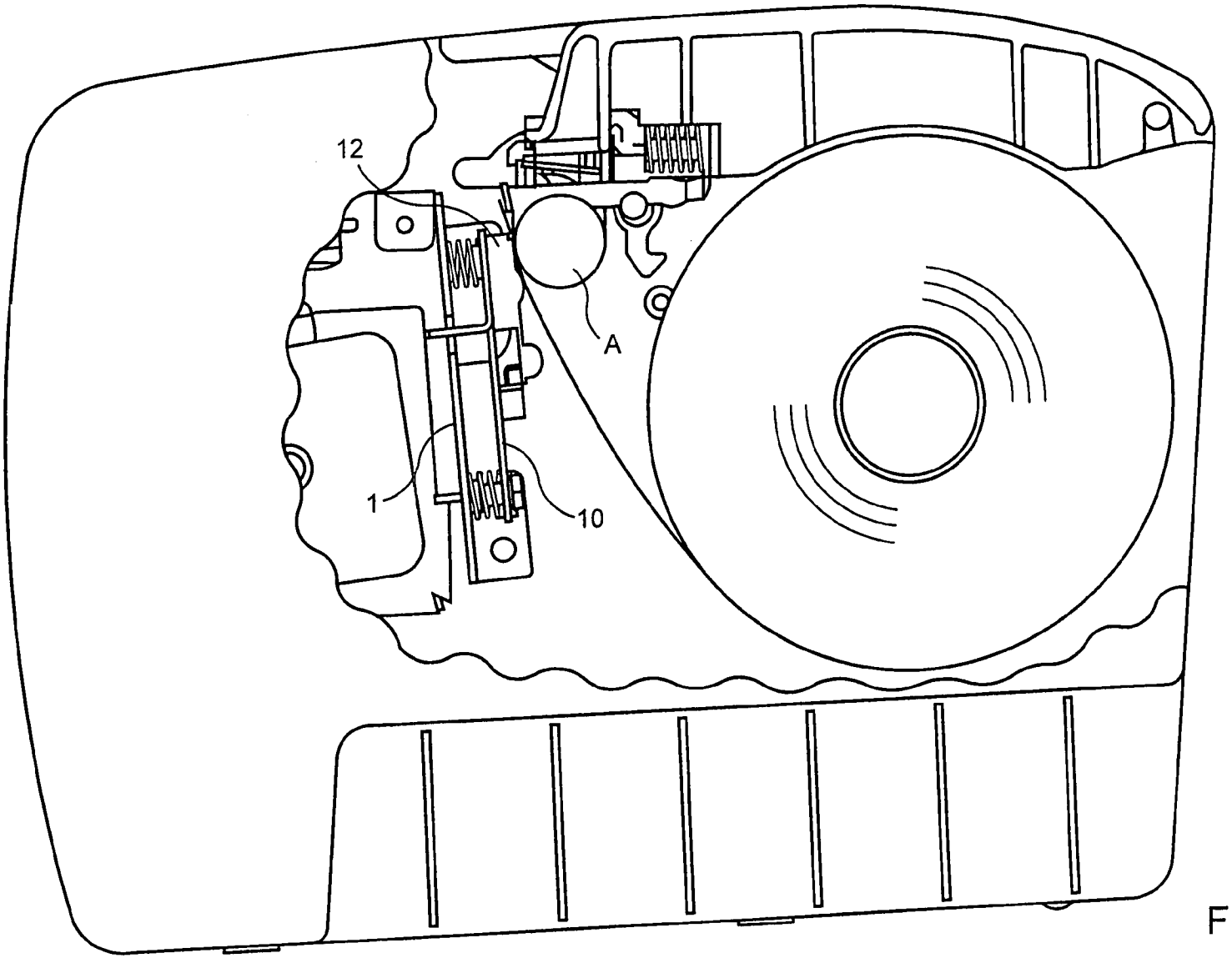
FIG. 15 is a schematic showing of a thermal printer and the relationship of the thermal head as viewed inside the thermal printer apparatus.

Referring now more particularly to FIG. 15 which shows a thermal printer apparatus having a paper feed rubbered roll A and the head support 10 for a thermal head 12. Upper plate 10 which carries and supports the thermal head 12 is juxtaposed to the paper drive roll A, and lower plate 1 is supported in a conventional manner with the thermal printer apparatus.

While there has been shown and described what is considered to be the preferred embodiments and best mode of the invention, it will be obvious to those skilled in the art that various changes and modifications may be made without departing from the scope of the invention.

1. lower or first support plane or plate
2. rear or posterior fin
3. front or anterior fins
4. three cylindrical anterior ledges or lugs
5. other cylindrical ledge—a posterior cylindrical ledge—rear ledge having an inner cooperative and complimentary threaded portion
6. four springs, three anterior and one posterior spring
7. threaded members or three anterior screws
8. openings or anterior holes
9. anterior opening or elongated hole or opening in second support plate 10—oblong or oval shaped
10. second or upper support plane or plate
11. three blind holes or openings in thermal printer 12 having an interior threaded portion
12. thermal head
13. screw member with outer threaded shank portion
13. posterior screw
14. hole or posterior opening in 10
15. circular holes on posterior fins
16. substantially rectangular openings
17. protrusions
18. holes for front fins 13
19. squared or rectangularly shaped hole or opening
19A Semi-circular curved portion (FIG. 7)
20. hook
21. large dimensional squared or rectangular hole

The invention claimed is:

1. In a thermal printing apparatus, a head support for a thermal head, comprising:

first and second spaced plates, said first spaced plate being connected with said thermal printing apparatus, and said thermal head being supported by said second spaced plate for juxtaposition to a printing roller or said thermal printing apparatus;

connection means for connecting said first and second spaced plates together for movement of said thermal head relative to said printing roller;

resilient means associated with said first and said second spaced plates for permitting said second spaced plate to be movable relative to said first spaced plate in a longitudinal and a transverse direction whereby to maintain said printing head in proper contact with printing paper positioned between said printing head and said printing roller;

springs, and a support for said springs on said first spaced plate, and connectors associated with said second spaced plate coupled with said support and passing through said springs for permanently positioning said springs between said first and said second spaced plates; and wherein said springs include three anterior springs and a posterior spring which cooperate to overcome incorrect dispositions of said thermal head in a transversal way and compensation is determined by the said three front or anterior springs and by means of said posterior springs.

2. The head support as claimed in claim 1, wherein said first spaced plate is a support plate and is provided with a rectangular opening, and a hook member having one end connected to said second spaced support plate, said hook member having another end forming a connection end for insertion into said rectangular opening, said hook member maintaining said springs under compression and limiting relative mobility of said springs and relative displacement of said first and second spaced support plates relative to each other and thereby movement of said thermal head.

3. The head support as claimed in claim 1, wherein said springs provide an elastic connection between said first and said second support plates to permit a relative movement of the two support plates for compensating in such a way any incorrect dispositions of the paper drive roll relative to the thermal head.

4. The head support as claimed in claim 1, including three cylindrical anterior ledges and a posterior cylindrical ledge for maintaining said four springs inserted onto a proper one of said support ledges.

5. The head support as claimed in claim 1, wherein said first spaced plate is a support plate and is provided with a substantially rectangular opening, and a hook member having one end connected to said second spaced support plate, said hook member having another end forming a connection end for insertion into said substantially rectangular opening, said hook member maintaining some of said springs under compression and limiting relative expansion mobility of other of said springs and relative displacement of said first and second spaced support plates relative to each other and thereby movement of said thermal head.

6. The head support as claimed in claim 1, wherein said connection means includes fins on said first spaced plate having an opening and hook members connected with said second spaced plate having ends receivable within said opening in said fins for connecting said spaced plates together.

7. The head support as claimed in claim 1, wherein said resilient means includes:

three front ledges and one rear ledge on said first spaced plate, and a spring associated with each of said ledges;

three screws associated with said three front ledges passing through openings in said second spaced plate for connection of each individually with said three ledges and passing through said springs for connection with said ledges; and a fourth or rear connection member associated with said rear ledge passing the spring associated with said rear ledge for coupling a posterior portion of said first spaced plate and a posterior portion second spaced plate together.

8. The head support as claimed in claim 1, including fins folded at right angles to said first plate.

9. The head support as claimed in claim 1, wherein said second support plate is provided with three anterior openings for placement and alignment with said anterior three ledges, three connection members each having a shank portion provided with outer threads passing through said anterior openings and through said three screws and screwed into said anterior three ledges.

10. The head support as claimed in claim 9, wherein said thermal head includes three blind openings above said three anterior openings for receiving one end of said anterior screws for locking said thermal head to said second support plate, and said posterior screw passes through said posterior opening in said second support plate into engagement with said posterior ledge for locking the second support plate with said first support plate.

11. The head support as claimed in claim 1, including posterior fins provided with circular holes to actuate the assembling of the machine body by means of pins and connection parts and includes rectangular openings to contain protrusions extending from said first support plate.

12. The head support as claimed in claim 11, wherein the openings are substantially rectangularly-shaped openings.

13. The head support as claimed in claim 1, including anterior fins provided with holes for the connection with a body of the thermal apparatus.

14. In a thermal printing apparatus, a head support for a thermal head, comprising:

first and second spaced plates, said first spaced plate being connected with said thermal printing apparatus, and said thermal head being supported by said second spaced plate for juxtaposition to a printing roller or said thermal printing apparatus;

connection means for connecting said first and second spaced plates together for movement of said thermal head relative to said printing roller;

resilient means associated with said first and said second spaced plates for permitting said second spaced plate to be movable relative to said first spaced plate in a longitudinal and a transverse direction whereby to maintain said printing head in proper contact with printing paper positioned between said printing head and said printing roller;

said resilient means includes springs, and a support for said springs on said first spaced plate, and connectors associated with said second spaced plate coupled with said support and passing through said springs for permanently positioning said springs between said first and said second spaced plates; and said first spaced plate is a support plate and is provided with a rectangular opening, and a hook member having one end connected to said second spaced support plate, said hook member having another end forming a connection end for insertion into said rectangular opening, said hook member maintaining said springs under compression and limiting relative mobility of said springs and relative displacement of said first and second spaced support plates relative to each other and thereby movement of said thermal head.

15. In a thermal printer apparatus as claimed in claim 14, wherein said springs include three anterior springs and a posterior spring which cooperate to overcome incorrect dispositions of said thermal head in a transversal way and compensation is determined by the said three front or anterior springs and by means of said posterior springs.

16. The support base for thermal printer, as claimed in claim 14, wherein said springs compensate to permit longitudinal and transverse movement of said second support plate and said thermal head connected thereto for the disposition mistakes, such that the printing head comes to be positioned in optimum conditions independently to the construction and realization precision of the machine body.

17. In a thermal printing apparatus, a head support for a thermal head, comprising:

first and second spaced plates, said first spaced plate being connected with said thermal printing apparatus, and said thermal head being supported by said second spaced plate for juxtaposition to a printing roller or said thermal printing apparatus;

connection means for connecting said first and second spaced plates together for movement of said thermal head relative to said printing roller;

resilient means associated with said first and said second spaced plates for permitting said second spaced plate to be movable relative to said first spaced plate in a longitudinal and a transverse direction whereby to maintain said printing head in proper contact with printing paper positioned between said printing head and said printing roller;

said resilient means include springs, and a support for said springs on said first spaced plate, and connectors associated with said second spaced plate coupled with said support and passing through said springs for permanently positioning said springs between said first and said second spaced plates; and three cylindrical anterior ledges and a posterior cylindrical ledge for maintaining said four springs inserted onto a proper one of said support ledges.

18. In a thermal printing apparatus, a head support for a thermal head, comprising:

first and second spaced plates, said first spaced plate being connected with said thermal printing apparatus, and said thermal head being supported by said second spaced plate for juxtaposition to a printing roller or said thermal printing apparatus;

connection means for connecting said first and second spaced plates together for movement of said thermal head relative to said printing roller;

resilient means associated with said first and said second spaced plates for permitting said second spaced plate to be movable relative to said first spaced plate in a longitudinal and a transverse direction whereby to maintain said printing head in proper contact with printing paper positioned between said printing head and said printing roller;

said resilient means include springs, and a support for said springs on said first spaced plate, and connectors associated with said second spaced plate coupled with said support and passing through said springs for permanently positioning said springs between said first and said second spaced plates; and said first spaced plate is a support plate and is provided with a substantially rectangular opening, and a hook member having one end connected to said second spaced support plate, said hook member having another end forming a connection end for insertion into said substantially rectangular opening, said hook member maintaining some of said springs under compression and limiting relative expansion mobility of other of said springs and relative displacement of said first and second spaced support plates relative to each other and thereby movement of said thermal head.

19. In a thermal printing apparatus, a head support for a thermal head, comprising:

first and second spaced plates, said first spaced plate being connected with said thermal printing apparatus, and said thermal head being supported by said second spaced plate for juxtaposition to a printing roller or said thermal printing apparatus;

connection means for connecting said first and second spaced plates together for movement of said thermal head relative to said printing roller;

resilient means associated with said first and said second spaced plates for permitting said second spaced plate to be movable relative to said first spaced plate in a longitudinal and a transverse direction whereby to maintain said printing head in proper contact with printing paper positioned between said printing head and said printing roller;

said resilient means includes springs, and a support for said springs on said first spaced plate, and connectors associated with said second spaced plate coupled with said support and passing through said springs for permanently positioning said springs between said first and said second spaced plates; and said resilient means includes:

three front ledges and one rear ledge on said first spaced plate, and a spring associated with each of said ledges;

three screws associated with said three front ledges passing through openings in said second spaced plate for connection of each individually with said three ledges and passing through said springs for connection with said ledges; and a fourth or rear connection member associated with said rear ledge passing the spring associated with said rear ledge for coupling a posterior portion of said first spaced plate and a posterior portion second spaced plate together.

20. In thermal printing apparatus, a head support for a thermal head, comprising:

first and second spaced plates, said first spaced plate being connected with said thermal printing apparatus, and said thermal head being supported by said second spaced plate for juxtaposition to a printing roller or said thermal printing apparatus;

connection means for connecting said first and second spaced plates together for movement of said thermal head relative to said printing roller;

resilient means associated with said first and said second spaced plates for permitting said second spaced plate to be movable relative to said first spaced plate in a longitudinal and a transverse direction whereby to maintain said printing head in proper contact with printing paper positioned between said printing head and said printing roller;

said resilient means includes springs, and a support for said springs on said first spaced plate, and connectors associated with said second spaced plate coupled with said support and passing through said springs for permanently positioning said springs between said first and said second spaced plates; and said second support plate is provided with three anterior openings for placement and alignment with said anterior three ledges, three connection members each having a shank portion provided with outer threads passing through said anterior openings and through said three screws and screwed into said anterior three ledges.

* * * * *